US006406070B1

(12) United States Patent
DeLange et al.

(10) Patent No.: US 6,406,070 B1
(45) Date of Patent: Jun. 18, 2002

(54) CASING DRILLING CONNECTOR WITH LOW STRESS FLEX GROOVE

(75) Inventors: Richard W. DeLange, Kingwood; Ed Evans, Spring; Richard Griffin, Houston, all of TX (US)

(73) Assignee: Grant Prideco, LP, The Woodlands, TX (US)

( * ) Notice: Subject to any disclaimer, the term of this patent is extended or adjusted under 35 U.S.C. 154(b) by 0 days.

(21) Appl. No.: 09/706,204

(22) Filed: Nov. 3, 2000

(51) Int. Cl.[7] ..... F16L 25/00
(52) U.S. Cl. ..... 285/333; 285/334
(58) Field of Search ..... 285/333, 334, 285/355, 390

(56) References Cited

U.S. PATENT DOCUMENTS 2,825,585 A * 3/1958 Griffin ..... 285/333 X
4,892,337 A * 1/1990 Gunderson et al. ..... 285/333
4,943,095 A * 7/1990 Sugimura ..... 285/334
5,197,553 A 3/1993 Leturno
5,355,968 A 10/1994 Smith
5,358,285 A * 10/1994 Wilson ..... 285/114
5,505,502 A * 4/1996 Smith et al. ..... 285/334
5,681,059 A * 10/1997 Mackie ..... 285/94
5,853,199 A * 12/1998 Wilson ..... 285/45
5,931,511 A 8/1999 DeLange et al.
6,050,610 A * 4/2000 Enderle et al. ..... 285/94

* cited by examiner

*Primary Examiner*—Teri Pham Luu
(74) *Attorney, Agent, or Firm*—Loren G. Helmreich; Browning Bushman P.C.

(57) ABSTRACT

An oilfield tubular string 10, 60, 60A comprising a plurality of elongate joints having one or both ends threaded. The joints may be connected by a coupling including a generally sleeve shaped coupling body having a tapered upstream thread profile and a tapered downstream thread profile for threaded engagement with a mating profile of a respective joint. The coupling body includes a low stress flex groove 30 having a selected box thread runout bevel angle, and all transitions in the flex groove between surfaces are radiused to greater than 0.100 inches to minimize stress risers. A pin-in-box connection between tubular joints includes mating tapered threads 72, engagement of end shoulder 74, 76, 78, and 80, and a low stress flex groove 82. The present invention allows the elongate joints to be used as both a casing string and a drill string, thereby saving significant time and expense.

20 Claims, 3 Drawing Sheets

CASING DRILLING CONNECTOR WITH LOW STRESS FLEX GROOVE

FIELD OF THE INVENTION

The present invention relates to oilfield tubulars of the type subjected to high torsion and/or bending forces. More particularly, the present invention relates to an improved drilling connector with a low stress flex groove. The present invention is particularly well suited for oilfield casing drilling tubulars connected by threaded couplings to serve as the drill string, but may also may be used with a pin-in-box oilfield drilling casing to serve as the drill string.

BACKGROUND OF THE INVENTION

Because many of the known oil and gas fields in the world that are economical to drill with traditional methods have already been developed, new methods are needed that cost less so that the additional fields can be economically developed. One of the most important current developmental efforts being evaluated by operators includes drilling a well using the casing as the drill string, instead of using both casing and drill pipe. This method may save significant time and drill pipe costs and may make a large number of fields economically justified that are currently not justified using traditional methods.

New techniques have also been developed that allow the operator to drill the well without traditional drill pipe by attaching a downhole mud motor with a drill bit to the bottom of the casing. The mud motor thus rotates the drill bit. However, this method generally requires expensive downhole assemblies, including the mud motor. Also, if the drill string is not rotating, the efficiency by which the cuttings are circulated to the surface is reduced.

The present invention allows the operator to rotate the drill bit by rotating the casing. This idea, while not novel, is practically manifested in the drilling connector of the present invention. According to the present invention, the casing thus may completely eliminate the drill pipe, possibly also with enhancement in the retrieval of cuttings. Moreover, the drilling connector of the present invention eliminates the need for a mud motor and other associated equipment, thereby saving additional expenditures and reducing the complexity of the recovery system.

SUMMARY OF THE INVENTION

A primary objective of this invention is to increase the fatigue resistance of typical connectors (e.g., low cost API connector designs) subject to high bending and/or torsional forces. This objective allows the tubular casing to be economically used as the drill string, which has long been desired by those skilled in the art.

It is a further objective of this invention to provide a drilling connector with a high resistance to torsional loads created while drilling with the casing.

It is a further objective of this invention to minimize the stresses in the areas of the drilling connector that are most likely to suffer fatigue failures upon torsion and/or bending.

It is a feature of this invention to incorporate a long, gradual bevel on the OD of the drilling connector coupling that will minimize the stress in the casing near the end of the coupling. Abrupt changes in stiffness in any mechanical part of the connector are reduced or eliminated, thereby decreasing stresses and stress risers.

It is also a feature of this invention to allow an improved oilfield tubular that may be upset (forged) on one or both ends, which would eliminate the need for a coupling.

It is a further feature of this invention to provide a drilling connector that incorporates a torque shoulder at the outermost location for the casing joint that has been upset on both ends.

It is a feature of this invention the threads at the base of the pin run-out on the exterior surface of the threaded end of the pin (casing). As the threads approach the O.D., the threads "run-out" to reduce stress in that area of the connection.

DETAILED DESCRIPTION OF PREFERRED EMBODIMENTS

According to the present invention, casing may be manufactured in any desired lengths, typically about 40 feet. To connect these joints together as they are run into the well requires threaded connectors. Typical casing connectors are designed to have a fairly streamlined profile so as to maximize the amount of space in the annulus. These traditional connectors have not been designed to resist the cyclic loading associated with rotating the string (drilling), which may cause premature fatigue failures. Casing connectors are normally rotated very little, if at all, when run downhole so designing for fatigue resistance has never been important.

Larger connector designs exist that are designed with the primary characteristic of being highly fatigue resistant. However, these designs are typically very expensive and take up too much space downhole. They also are typically welded onto the pipe (another expense).

The invention has several features. First, the pin connectors may incorporate a thread "runout" at the outermost part of the connector, such that the thread disappears at the casing OD. This minimizes the amount of stress generated in the thread body, because virtually all of the casing body wall thickness is experiencing the loads. If the thread is not machined as a "runout" thread, the connector load carrying cross-sectional area is significantly less than the casing body wall thickness, which generates a much higher stress than the stress in the casing body (same load divided by a smaller cross-sectional area).

Second, the pin noses (ends) may, in their final made up position, shoulder against each other. This feature allows the connector to resist relatively high torsional loads. The connector may also be made up with much more torque, thereby making the connector more resistant to backoff while rotating the casing as a drill string.

Because the pin noses shoulder and much more torque may be applied to the connector, the coupling's center section directly above the pin noses is also much more highly stressed. To minimize the effect cyclic loading has in this area (maximize fatigue resistance), some of the box threads may be machined away to create a runout thread near the most interior section of the coupling.

The connector may also be machined on casing joints upset on both ends by using ½ of the coupled design. In this configuration, a second torque shoulder may be incorporated at the outermost part of the connector. The connector may also be machined on an upset on one end only, again by using ½ of the coupled design. In this case, there is not an apparent option for an external torque shoulder.

Figure 1:
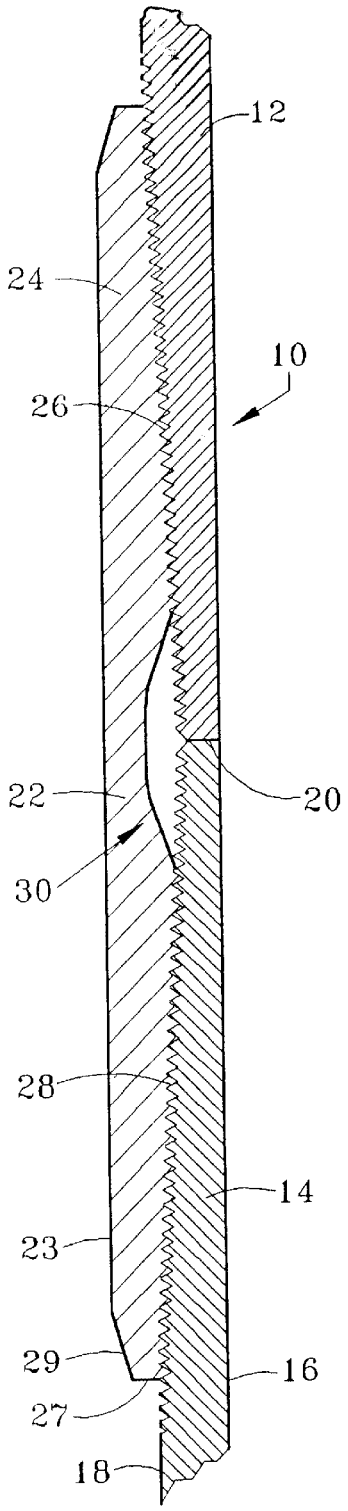
FIG. 1 is a simplified cross sectional view of an oilfield tubular according to the present invention, with the tubular joints connected with a coupling.

FIG. 1 illustrates a suitable connecter 10 according to the present invention for interconnecting an upstream casing joint 12 with a downstream casing joint 14. Each of the casing joints may have identical threaded ends, and joints typically will have the same diameter interior surface 16 and the same diameter exterior cylindrical surface 18. When the connection 10 is made up, the pin end surfaces of the casing joints 12 and 14 preferably contact each other along a planar shoulder 20.

As shown in FIG. 1, a generally sleeve shaped coupling body 24 has a central axis 25 coaxial with the central axis of both the upstream casing 12 and the downstream casing 14. The body 24 also has a tapered upstream thread profile for threaded engagement with a mating thread profile 26 on the upstream elongate joint 12. Similarly, the coupling body has a tapered downstream thread profile for mating engagement with a mating profile 28 on the downstream elongate joint 14. In a typical embodiment, the body 24 has a generally cylindrical outer surface 23. Each end of the body 24 has a substantially planar end surface 27 which is typically perpendicular to the central axis 25. Frustoconical surface 29 connects the outer cylindrical surface 23 with each of the upper and lower end surfaces 27.

Generally shown in FIG. 1, the body 24 includes a generally central section 22 which is spaced midway between the end surfaces 27. The center section 22 includes the flex groove 30 as shown in FIG. 1 and as shown in much greater detail in FIG. 2.

Figure 2:
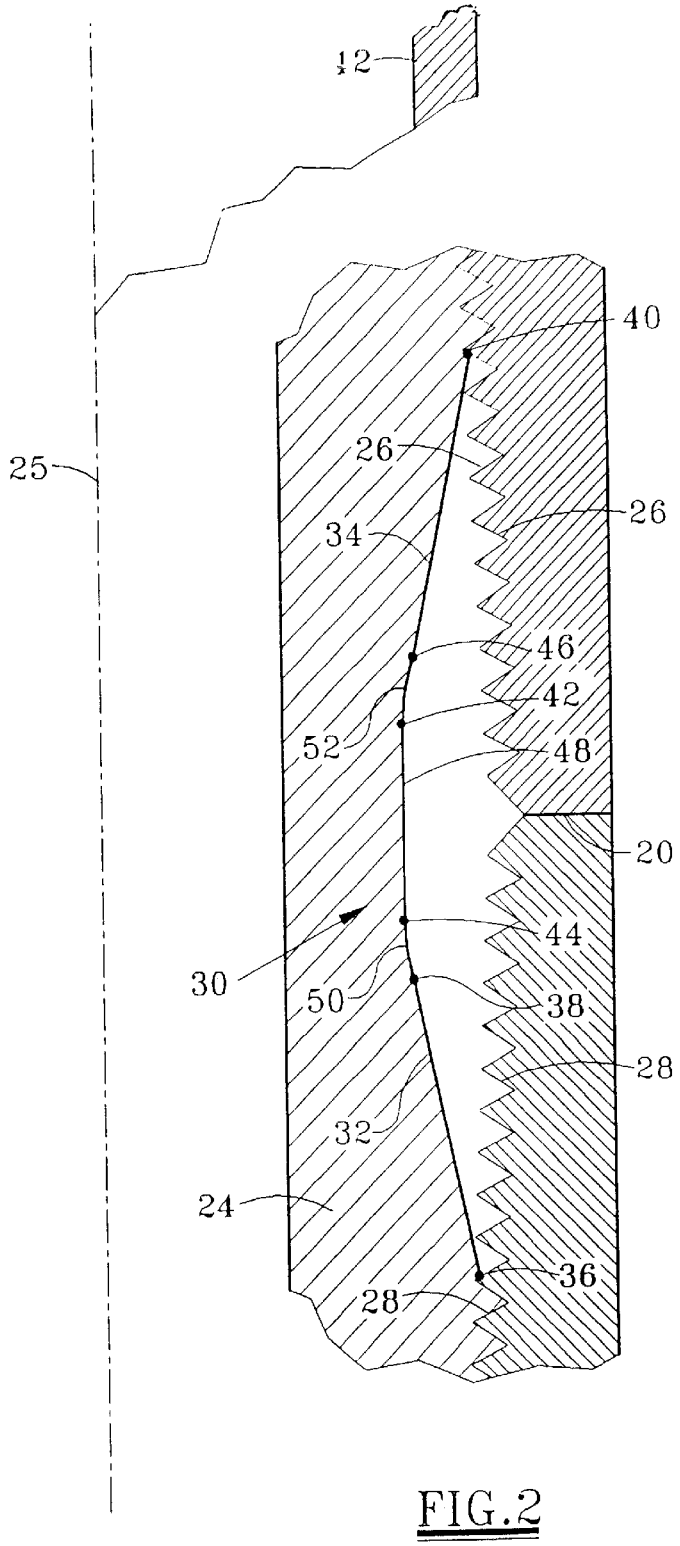
FIG. 2 is an enlarged view of a portion of the connector shown in FIG. 1.

In a preferred embodiment, the axially central section of the flex groove includes a radially outermost flex groove surface 48, which is also preferably a cylindrical surface extending between points 44 and 46. The planar surface 48 transitions to a downstream radiused surface 50 and an upstream radiused surface 52. The surface 50 thus extends from points 38 to 44 while the surface 52 extends from points 46 to 42. Each of these radiused surfaces in turn then continues as a upper taper frustoconical runout bevel 34 extending between points 42 and 40, and a downstream frustoconical surface 32 extending between points 38 and 36. The angle of the thread runout bevel may be from 0° (relative to axis 25) to about 45°. A preferred thread runout bevel is from about 5° to about 30°. Referring both to FIGS. 1 and 2, the connection 10 of the present invention preferably has a thread runout bevel as discussed above.

Figure 2A:
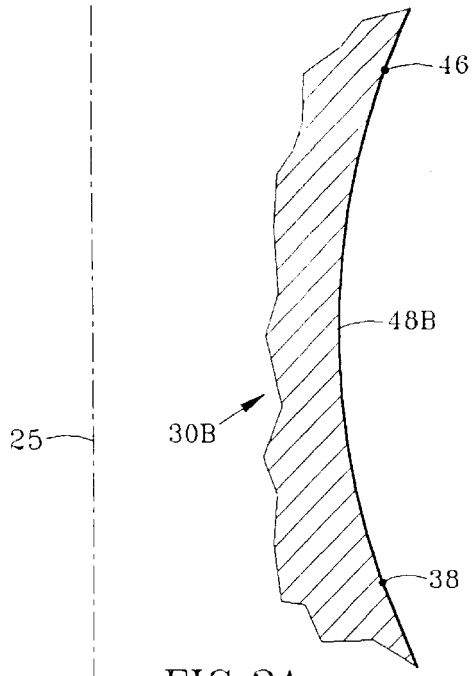
FIG. 2A is an alternative to the portion shown in FIG. 2.

Each of the radiused surfaces 50 and 52 which transitions between the flat surface 48 and the tapered surfaces 32 and 34 has a radius preferably greater than 0.100 inches to minimize stress risers. FIG. 2A shows an alternative stress grove 30B wherein the surface between points 46 and 44 is a radiused surface 48B. The tapered threads 26 and 28 are also runout threads at each end of the coupling body 24.

Figure 3:
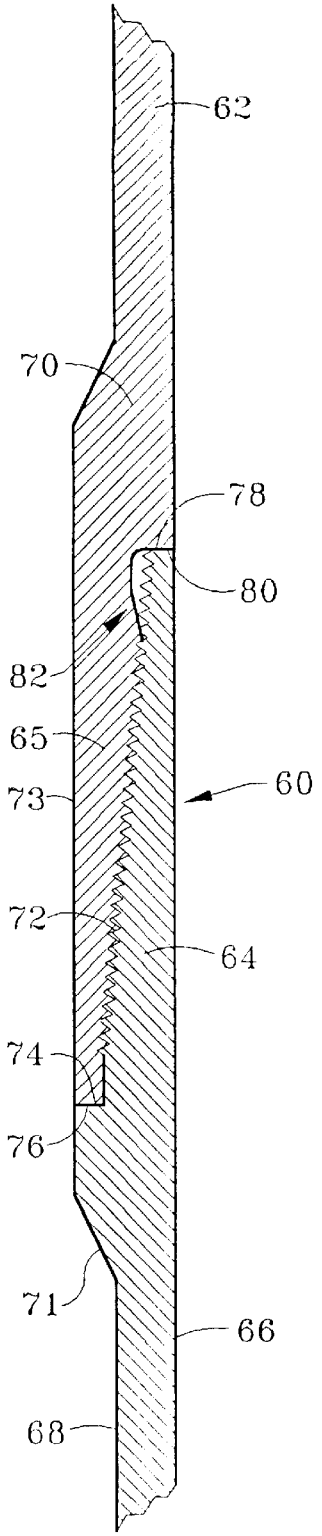
FIG. 3 is a simplified pictorial view of an oilfield tubular connector according the present invention in a pin-in-box configuration.

FIG. 3 depicts one embodiment of an oilfield tubular string according to the present invention comprising elongate joints 62 and 64, which each have a cylindrical interior surface 66 and cylindrical exterior surface 68. Mating ends of the joints are upset, as shown at 70, and typically have a tapered surface 71 connecting the outer cylindrical surface 68 with the outer surface 73 of the connector 60. In this case, the upset of the upstream tubular 62A forms a box 65, while the upset of the downstream tubular 66 forms a pin 64. Each of the box and pin have mating threads 72 for engagement when the connection 10 is made up. The end surface 78 of the pin 64 is a planar surface preferably perpendicular to the centerline 25, and engages a shoulder surface 80 on the box. The end surface 76 of the box is also preferably a planar surface perpendicular to the centerline 25, and engages a mating planar shoulder surface 74 on the pin. Thus each end of the box and the pin is shouldered when the connection is made up.

Figure 4:
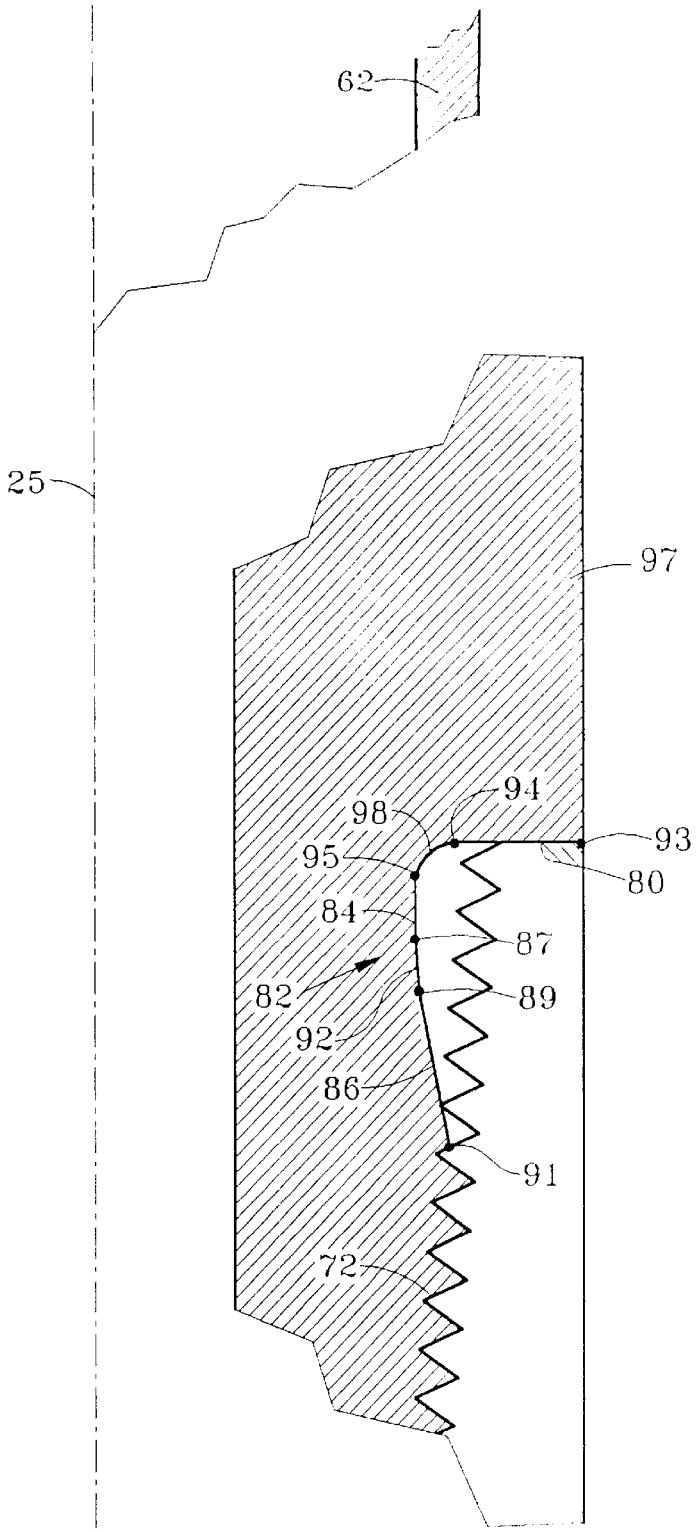
FIG. 4 is an enlarged view of a portion of the connector shown in FIG. 3.

As shown generally in FIG. 3 and more specifically in FIG. 4, the connection 10 includes a low stress flex groove 82. This groove 82 preferably includes a radially outermost cylindrical planar surface 84 between points 87 and 95, a radiused surface 92 between points 87 and 89, and a frustoconical runout surface 86 between points 89 and 91. The groove also includes a radiused surface 92 between the points 95 and 94, a planar shoulder surface 80 between the points 93 and 94. The runout surface 86 preferably has the features of the runout bevel surface discussed above.

Figure 5:
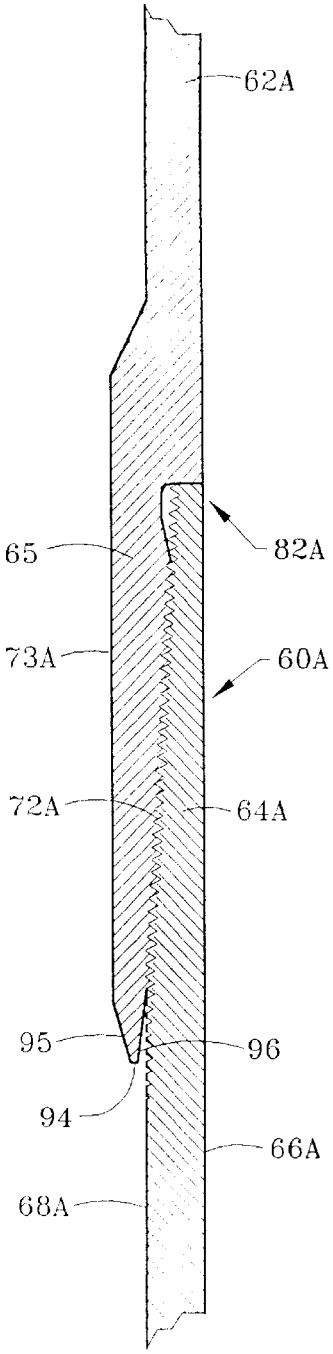
FIG. 5 is an alternative embodiment of the oilfield tubular connector shown in FIG. 3.

FIG. 5 illustrates another embodiment of a connector 60A according to the present invention which has a low stress flex groove 82A substantially the same as the flex groove discussed above. This embodiment is different, however, since the end surface of the box is not intended for shouldering with the upset on the pin. Accordingly, the shouldering provided by the surfaces 74 and 76 as shown in FIG. 3 does not exist in the FIG. 5 embodiment. Instead, the end surface 94 on the box 65A may be radially outward of the surface 68A of the lower joint 64A. That surface may be interconnected with the substantially cylindrical outer surface 73A by a frustoconical tapered runout surface 95. If desired, a similar frustoconical tapered surface 96 may interconnect the surface 94 with the thread 72A.

Figure 6:
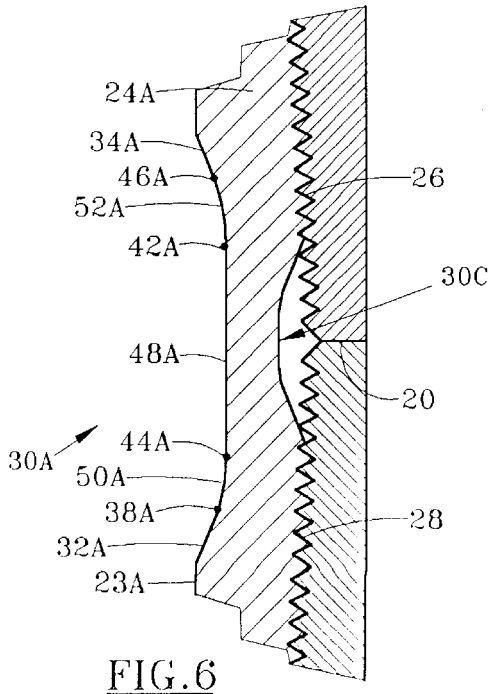
FIG. 6 is an alternative to the enlarged portion shown in FIG. 2.

FIG. 6 illustrates an alternative connector, wherein the flex groove is provided on an exterior of the coupling body 24A. In the FIG. 6 embodiment, the stress grove 30A is provided on an exterior surface of the coupling body 24A, thereby forming a radially inward projecting annular groove from the coupling body outer cylindrical surface 23A. This exterior groove may be both structurally and functionally similar to the groove shown in FIG. 2 provided on the interior of the coupling body, and accordingly designations with and "A", such as 30A, are used to refer to components corresponding to the interior stress groove 30 shown in FIG. 2. In addition, a second stress groove, in this case an interior stress groove 30C, is optionally also provided. This stress groove 30C may be similar to the FIG. 2 stress groove, but inherently will be a much smaller dimensional stress groove since sufficient material for the coupling must be maintained. The transition in the one or both stress grooves according to the present invention, and thus is both of the stress grooves 30A and 30C as shown in FIG. 6, are thus raised as discussed above.

The low stress flex groove according to the present invention has three primary features which relate to (a) box thread runout bevel (b) radiused transition and (c) center flat: (1) The box thread runout bevel creates a runout thread at the end of the box threads. The angle preferably is greater than 0° (parallel to the pipe axis) and steep enough to create a runout of two thread pitches. Therefore, the angle is a function of (a) thread height and (b) thread taper. A typical angle according to the present invention is from 5° to 30°. (2) All transitions between flat surfaces are radiused to minimize stress risers. This radius should not be the typical 0.010 inch, because sharp radii in the area of 0.010 inches or less, which are typical in grooves used in connectors for seal rings and is also satisfactory for removal of imperfect threads, generate very high stress at locations where there is a change in stiffness (thickness). Radii greater than 0.300 inches, on the other hand, offer no appreciable additional reduction in stress and begin to interfere with creating a box thread runout. (3) The center section may be flat or radiused. A preferred embodiment is flat because this maximizes the coupling's thickness in the highly loaded center section.

In a preferred embodiment, the groove in the coupling may be cold rolled or peened, for inducing a compressive stress in the area of the coupling under the groove. This initial compressive stress serves to reduce the resulting alternating stress imposed on the coupling during rotation of the string during drilling operations. The alternating stress induces fatigue in the body of the coupling which can lead to failure of the connection.

Those skilled in the art will appreciate that the oilfield tubular string of the present invention in a typical application comprises a plurality of elongate joints each having one or both ends threaded for engagement with another elongate joint having one or both ends threaded. The term "elongate joint" is used herein to broadly encompass both a conventional tubular joint, e.g., a 30 foot joint, or another generally elongate tubular member for structurally interconnecting joints in the tubular string and having a flow path therein in fluid communication with the flow path of other joints in the tubular string. Accordingly, the term "elongate joint" would include, for example, a housing of a downhole tool, with one end of the housing having threads for mated engagement with an elongate joint or another tool.

While the tubular of the present invention has been discussed above as a drilling casing, the improved tubular with the low stress flex groove may be used on the other tubular strings, and particularly strings, subjected to high bending and/or torsional forces.

It will be understood by those skilled in the art that the embodiment shown and described is exemplary and various other modifications may be made in the practice of the invention. Accordingly, the scope of the invention should be understood to include such modifications which are within the spirit of the invention.

What is claimed is:

1. An oilfield tubular string comprising a plurality of elongate joints each having one or both ends threaded for engagement with another elongate joint having one or both ends threaded, the threaded ends of each joint being structurally interconnected by a coupling, the coupling comprising:

a generally sleeve shaped coupling body having a central axis and a tapered upstream thread profile for threaded engagement with a mating thread profile on an upstream elongate joint;

the coupling body having a tapered downstream thread profile for threaded engagement with a mating profile on a downstream elongate joint; and the coupling body having a low stress flex groove along a radially inner surface of the coupling body and axially between the tapered upstream thread profile and the tapered downstream thread profile, the flex groove having a selected upstream thread runout bevel angle and a selected downstream thread runout bevel angle each greater than 0° relative to the central axis of the coupling body, each bevel angle being functionally related to thread height and thread taper, with all transitions in the flex groove between surfaces being radiused to greater than 0.100 inch to minimize stress risers.

2. The oilfield tubular string as defined in claim 1, wherein the adjacent ends of the elongate joints include a planar upstream joint end surface and a planar downstream joint end surface, the planar upstream joint end surface engaging the planar downstream joint end surface when the coupling is threaded to the elongate joints.

3. The oilfield tubular string as defined in claim 1, wherein one or both of the thread mating profiles runout on the tubular joint OD to minimize stress.

4. The oilfield tubular string as defined in claim 1, wherein the stress groove comprises a substantially planar radially outer surface, an upstream radiused surface and a downstream radiused surface on upstream and downstream sides of the substantially planar surface, and an upstream tapered surface and a downstream tapered surface on the upstream and downstream sides of the substantially planar upstream radiused surface and the downstream radiused surface, each of the tapered surfaces intersecting a respective thread profile on the coupling body.

5. The oilfield tubular string as defined in claim 4, wherein the upstream and downstream radius surfaces are equally spaced axially from a center of the radially outer surface, and wherein the tapered upstream surfaces and the tapered downstream surfaces are each substantially equally spaced from the center of the radially outer surface.

6. The oilfield tubular string as defined in claim 1, wherein the planar radially outer surface of the flex groove is a substantially cylindrical surface with respect to the centerline of the coupling body.

7. The oilfield tubular string as defined in claim 1, wherein the selected angle of each thread runout bevel is from 5° to 30°.

8. The oilfield tubular string as defined in claim 1, wherein all transition radii are less than about 0.300 inches.

9. The oilfield tubular string as defined in claim 1, wherein all transition radii are from about 0.150 inches to about 0.250 inches.

10. The oilfield tubular string as defined in claim 1, wherein the planar radially outer surface of the flex groove is a radiused surface.

11. An oilfield tubular string comprising elongate joints each having a pin connector with pin threads for threaded engagement with a box connector having mating box threads, the connector having a central connector axis and comprising:

a tapered pin thread profile for mated engagement with a mating a box thread profile;

the pin thread running out on an outer surface of the tubular string; and a low stress flex groove along a radially inner surface of the box connector and axially spaced between the pin threads and the box threads when the connector is made up, the flex groove having a selected thread runout bevel angle greater than the 0° relative to the central axis of the connector, the bevel angle being functionally related to thread height and thread taper, and all transitions in the flex groove between surfaces being radiused greater than 0.100 inches to minimize stress risers.

12. The oilfield tubular string as defined in claim 11, wherein one or both of the thread profiles runout on the tubular joint OD to minimize stress.

13. The oilfield tubular string as defined in claim 11, wherein the stress groove comprises a substantially planar radially outer surface, an upstream radiused surface and a downstream radiused surface on upstream and downstream sides of the substantially planar surface, and a tapered runout bevel angle surface intersecting the tapered pin thread profile.

14. The oilfield tubular string as defined in claim 13, wherein the upstream and downstream radius surfaces are equally spaced vertically from a center of the radially outer surface, and wherein the tapered upstream surfaces and the tapered downstream surfaces are each substantially equally spaced from the center of the radially outer surface.

15. The oilfield tubular string as defined in claim 11, wherein the planar radially outer surface of the flex groove is a substantially cylindrical surface with respect to the centerline of the coupling body.

16. The oilfield tubular string as defined in claim 11, wherein the angle of the thread runout bevel is from 5° to 30°.

17. The oilfield tubular string as defined in claim 11, wherein all transition radii are from about 0.150 inches to about 0.250 inches.

18. A method of forming an oilfield tubular string comprising elongate joints each having one or both ends threaded for engagement with another elongate joint having one or both ends threaded, the method comprising:

providing at least one tapered thread profile on one of the joints and a mating tapered thread profile on one of a coupling and another of the joints for interconnecting the joints;

providing a low stress flex groove along a radially outer surface of the connector;

forming a selected runout bevel angle in the flex groove greater than 0° relative to the central axis of the connector, the bevel angle being functionally related to thread height and thread taper; and forming all transitions in the flex groove between surfaces to have a radius greater than 0.100 inch to minimize stress risers.

19. The method as defined in claim 18, further comprising:

forming the flex groove to have a substantially planar radially outer surface, an upstream radiused surface and a downstream radiused surface on upstream and downstream sides of the substantially planar surface, and an upstream tapered runout bevel surface and a downstream runout bevel tapered surface on the upstream and downstream sides of the substantially planar upstream radiused surface and the downstream radiused surface, each of the tapered surfaces intersecting a respective thread profile on the coupling body.

20. The method as defined in claim 18, further comprising:

running out the at least one threaded profile on a tubular joint to minimize stress; and rotating a drill bit by rotating the drill string.

* * * * *